United States Patent [19]

Graf

[11] Patent Number: 4,715,409

[45] Date of Patent: Dec. 29, 1987

[54] DEVICE FOR COUPLING A HEDDLE FRAME WITH A DRIVING ELEMENT

[75] Inventor: Martin Graf, Horgenberg, Switzerland

[73] Assignee: Grob & Co. Aktiengesellschaft, Horgen, Switzerland

[21] Appl. No.: 927,165

[22] Filed: Nov. 5, 1986

[30] Foreign Application Priority Data

Nov. 19, 1985 [DE] Fed. Rep. of Germany ..... 3541042

[51] Int. Cl.[4] ..... D03C 13/00

[52] U.S. Cl. ..... 139/88

[58] Field of Search ..... 139/82–91, 139/57

[56] References Cited

U.S. PATENT DOCUMENTS

| | | | |
|---|---|---|---|
| 4,083,385 | 4/1978 | Pfarrwaller | 139/57 |
| 4,365,653 | 12/1982 | Freisler et al. | 139/88 |
| 4,369,815 | 1/1983 | Gehring et al. | 139/82 |
| 4,541,459 | 9/1985 | Palau | 139/88 |

FOREIGN PATENT DOCUMENTS

| | | | |
|---|---|---|---|
| 1817613 | 7/1970 | Fed. Rep. of Germany | 139/82 |
| 2408672 | 7/1979 | France | 139/57 |
| 740875 | 6/1980 | U.S.S.R. | 139/82 |
| 861423 | 9/1981 | U.S.S.R. | 139/88 |

*Primary Examiner*—Henry S. Jaudon

*Attorney, Agent, or Firm*—Watson, Cole, Grindle & Watson

[57] ABSTRACT

One coupling element secured to a heddle frame has a pivotally mounted bolt latch for interlocking with another coupling element connected to a drive member when the another element is inserted in an opening of the one element to couple the heddle frame with the drive member. Toothing on the bolt latch and toothing on the another coupling element come into the locking position by a toggle lever pivotally mounted on the one element. The toggle lever has a manual operating lever, and a further lever element hinged thereon and comprising a bolt-shaped part surrounded by a tensioned helical compression spring which is supported between two abutments which are constructed as hinges for connection of the lever to the manual operating lever and to the bolt latch. One abutment is fixed to the bolt, and the other abutment is slidable relative to the bolt to a limited longitudinal extent determined by stops formed by an over-sized bore in the hinge receiving a pin carried by the bolt. In the over dead-center position of the toggle lever, in which the bolt latch is urged into the locking position, a cam-shaped projection on the manual operating lever abuts against an angled end of the L-shaped bolt latch. This mutual support is also present when, as a result of wear of the toothing, the bolt latch allows itself to be pressed slightly further, and the manual operating lever modifies its pivoting end position accordingly under the action of the spring. Thereby self-adjustment is ensured and the occurrence of play between the coupling elements is prevented.

7 Claims, 4 Drawing Figures

DEVICE FOR COUPLING A HEDDLE FRAME WITH A DRIVING ELEMENT

BACKGROUND OF THE INVENTION

The invention relates to a device for coupling a heddle frame with an oscillatory drive element comprising a pair of elements which are engageable one into the other and which, in use, are disposed one on the frame stave of the heddle frame and the other on the drive element, and a bolt latch which is pivotally mounted on one of the coupling elements so that it can be pressed against the other coupling element when the coupling elements are engaged, the bolt latch having wedge surfaces extending transversely to the direction of drive and arranged to co-operate with counter-surfaces on the other coupling element when the latch is pressed against it to produce a positive locking of the coupling elements in the engaged position.

There are numerous different coupling constructions for detachably connecting a heddle frame to the driving element which moves up and down, also called a drive bar. In these constructions the coupling elements are generally designed with a particular aim, such as to prevent too rapid a wear of the coupling parts, or to provide a very fast and simple engagement and disengagement, or to enable a whole series of heddle frames placed one behind the other to be coupled or uncoupled from the driving elements simultaneously.

In a known arrangement of the last mentioned type, a locking element, which is pivotally mounted on a coupling element and is provided with wedge surfaces for co-operation with counter-wedge surfaces on the other coupling element associated with the heddle frame, is actuated by means of a rotatably mounted adjusting cam which has a square hole for the insertion of an actuating rod which can be simultaneously passed through the cam in the coupling devices of a plurality of heddle frames disposed one behind the other, so that all the heddle frames can be simultaneously separated from the driving elements. In the engaged position the cam presses against a rubber insert rigidly mounted on the locking element, and is held in this position by the tension of the pushed in rubber insert.

In operation the coupling parts are subjected to considerable forces as a result of the oscillating movement, and hence the securing of the cam in the locking position solely on the basis of the elasticity of the rubber material is not reliably ensured, particularly when, as a result of constant use and wear on the wedge surfaces of the coupling parts, a certain amount of play arises between them. This play, which is no present in the new condition, develops gradually and cannot be eliminated by means of the cam. The play brings with it very undesirable effects, such as the creation of mating rust, increased wear from the impacts occurring as a result of play, and vibration of the heddle frame, etc. With all drive coupling arrangements on heddle frames it is a drawback if a play-free connection is not ensured between the coupling parts even as they wear gradually.

SUMMARY OF THE INVENTION

With the aim of avoiding this drawback, according to the invention a device for coupling a heddle frame with an oscillatory drive element of the kind described is characterized by a toggle lever which is hinged to the bolt latch and is pivotally mounted on the same coupling element as the bolt latch for operating the latch, and which is pivotable against the action of a compression spring into an over dead center position in which the bolt latch is in the locking position, the toggle lever comprising an operating lever on a lever element which are interconnected by a joint, and the compression spring abutting on the joint and on the end of the lever element which is hinged to the bolt latch.

Preferably the bolt latch is L-shaped, and the toggle lever which is pivotally mounted on the coupling element has on its manual operating lever a cam-shaped projection which abuts against an angled end of the L-shaped bolt latch in the over dead center position of the toggle lever in such a way that the end of the bolt latch and the projection mutually support each other, even when the position of the bolt latch has altered through wear, thus ensuring play-free mutual engagement of the coupling elements.

With the device in accordance with the invention wear of the parts producing the positive locking is compensated by self adjustment, and no play between the coupling elements can develop.

BRIEF DESCRIPTION OF THE DRAWINGS

The invention will now be further described with reference to the accompanying drawings which illustrate a particular example of the coupling device in accordance with the invention and in which.

DETAILED DESCRIPTION OF THE INVENTION

Figure 2:
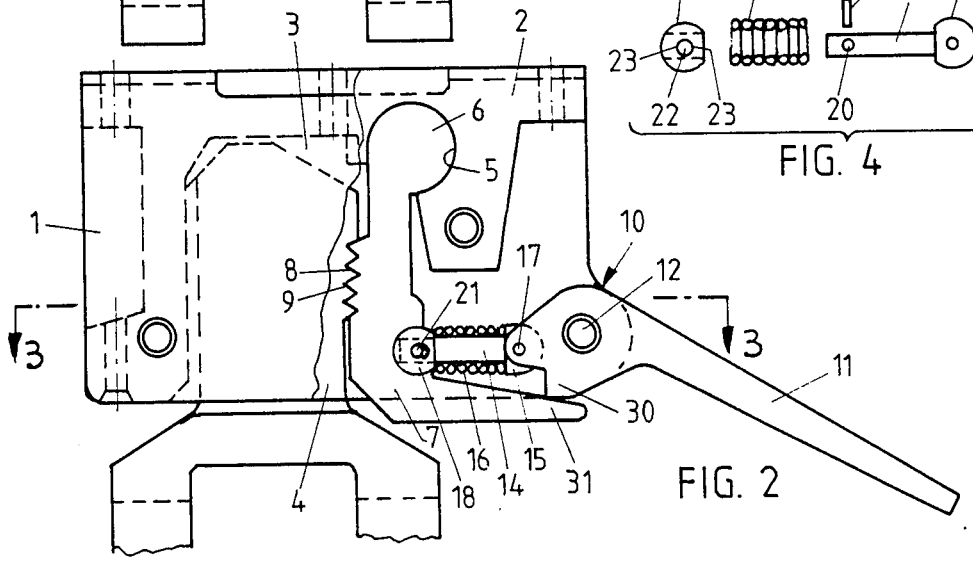
FIG. 2 is a view similar to that of FIG. 1, but after the coupling elements have been joined together.
Figure 3:
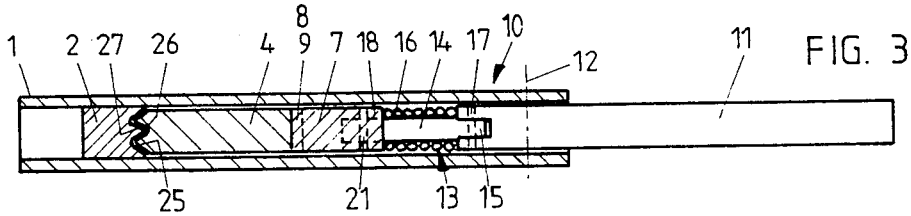
FIG. 3 is a horizontal cross-sectional view taken substantially along the line 3—3 in FIG. 2; and, FIG. 4 is an exploded view showing the components of a part of one of the coupling elements.

A housing 1, which is U-shaped in vertical section and open at the bottom and which, in use, is fixed on a frame stave of a heddle frame (not shown), has an insert part 2 which is fastened to the housing by rivets or screws. The assembled together housing and insert part define a hollow space 3, open at the bottom, into which a coupling element 4 of the device can be pushed, the second coupling element 4, in use, being moved up and down by means of, for example, a dobby loom. The insert part 2 fixed in the housing 1 has a recess 5 having an arcuate surface, and in this recess 5 the correspondingly shaped end 6 of a bolt latch 7 is pivotally mounted. The entire assembly of the housing 1, the insert part 2 and the bolt latch 7 form one coupling element 1, 2, 7. The bolt latch 7 has on one edge a toothing 8 which engages with a counter-toothing 9 on the coupling element 4 when the two coupling elements are engaged one into the other and the bolt latch 7 is pressed against the coupling element 4 as shown in FIG. 2. The teeth of the toothings 8 and 9 form co-operating wedge surfaces with the aid of which a positive locking is formed between the two coupling elements.

A toggle lever 10 is provided for pressing the bolt latch 7 against the coupling element 4. The toggle 10 comprises an operating lever 11 in the form of a handle and pivotably mounted in the housing 1 by means of a rotary shaft 12, and a further lever element 13 which connects the operating lever 11 to the bolt latch 7 and is hinged on both. The lever element 13 comprises a bolt 14 with a spring abutment 15 fixed firmly at one end thereof and forming a hinge part which is hinged by means of a pin 17 in the fork-shaped end of the operating lever 11. A helical compression spring 16 surrounds the bolt 14 and bears at one end on the abutment 15 and at the other end against an abutment 18 which is mounted on the bolt 14 for movement relative to the bolt 14 in a longitudinal direction to a limited extent. The abutment 18 also acts as a hinge part for the connection of the lever 13 to the bolt latch 7, the abutment 18 having an arcuate outer surface which is pivotally held in a corresponding recess 19 in the bolt latch 7.

Figure 4:
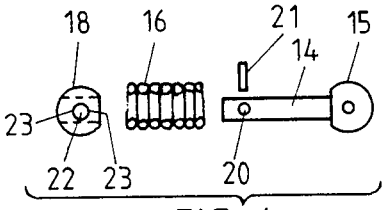

The bolt 14 has a cross-bore 20 through which a pin 21 extends in the assembled condition of the individual parts shown in FIG. 4, i.e. when the helical compression spring 16 and the sleeve abutment 18 are mounted on the bolt 14. This pin 21 also passes through a cross-bore 22 formed in the abutment 18 and having a diameter greater than the diameter of the pin 21. The oppositely-disposed walls of the cross-bore 22 thus form two stops 23 for the longitudinal movement of the abutment 18 on the bolt 14, and in this example the longitudinal movement of the abutment 18 is limited to about 0.5 mm.

Figure 1:
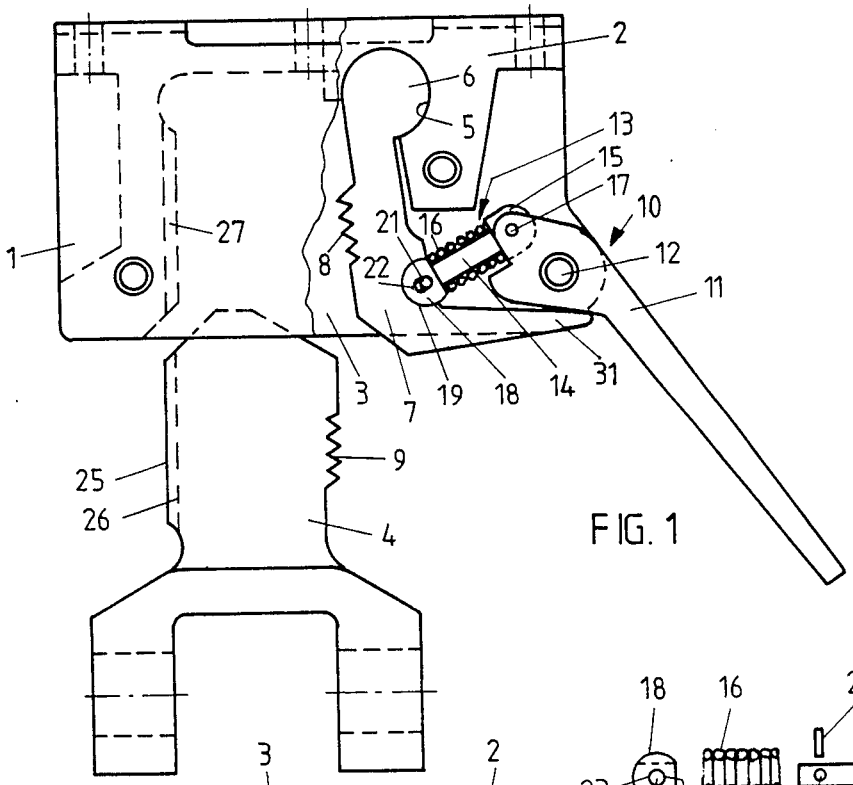
FIG. 1 is a partly cut-away side view of the coupling device in its open position before the coupling elements are joined together.

The compression spring 16 is incorporated as a part prestressed almost to its loading limit so that in the position of the toggle lever 10 shown in FIG. 1 the pin 21 engages the stop 23 at the near edge of the bore 22, i.e. on the right in the drawings, and the abutment 18 is pressed towards the end of the bolt 14. When the toggle lever 10 is pivoted into the position shown in FIG. 2 to press the bolt latch 7 agianst the inserted coupling element 4, the helical compression spring 16 is further compressed along the above-mentioned path of 0.5 mm until the pin 21 abuts on the opposite, i.e. the left, stop 23 of the abutment 18. As a result of the strong tension of the helical compression spring 16, maximum spring force is available for actuation. Furthermore, on rocking the toggle lever 10 out of the position according to FIG. 2 into the position according to FIG. 1 to permit separation of the coupling elements, after only a short pivoting path of the system the pressure of the spring is no longer operative, as the spring can only be released to the extent where the pin 21 abuts against the right hand stop edge 23 of the bore 22. It is therefore not necessary to have a pivot path for the toggle lever which would otherwise be of a magnitude corresponding to the full release of the spring, so that as a consequence of the small path and pivoting angle employed the device can be contructed to a small overall size and yet have high closure strength.

Instead of a helical compression spring it is possible in an alternative construction to have a leaf spring. However, to achieve similar effects, it must be correspondingly greatly dimensioned, and would be much more prone to breaking than a helical compression spring, the wire of which is stressed only in terms of tension.

The insertable coupling element 4 has on its narrow side opposite the toothing 9 a profile which is tooth-shaped in cross-section and which is provided by longitudinally extending projections 25 and a V-wedge-shaped groove 26 therebetween. The insert part 2 held in the housing, into which the coupling element 4 is received, has a corresponding tooth-shaped cross-sectional profile 27 formed on its side wall, so that when the coupling elements are engaged, the sides of the tooth-shaped strips are pressed one against the other, the side angle being selected in such a way that a high friction locking or force connection arises. This, together with the positive locking by means of the teeth of the toothing 8 and 9 on the oppositely-placed narrow side of the coupling element 4, holds the coupling elements in firm mutual connection.

The above-mentioned frictional locking connection by means of the longitudinally-extending projections 25 and the wedge-shaped groove 26 co-operating with the matching surface 27 on the part 2, as well as the positive locking connection by means of the teeth of the toothing 8 on the bolt latch 7 in collaboration with the teeth of the toothing 9 on the coupling element 4 will not retain the new condition during use. The wedge surfaces will of course wear to some extent, and as a result of frequent use further wear develops, so that play or idle movement between the parts to be coupled together could develop and lead to the formation of mating rust and to rapid wear or different parts of the device, were it not prevented in the present device as a result of various measures of a constructional nature. This is achieved in that the manual operating lever 11 of the toggle lever 10 has a cam-shaped projection 30 by means of which, in the over dead-center position shown in FIG. 2, in which the bolt latch 7 is in the locking position and the helical compression spring 16 is compressed, it abuts against the angled end 31 of the L-shaped bolt latch 7. If, as a result of wear on the wedge surfaces of the teeth of toothings 8 and 9 and/or the profiled surfaces 25–27, the bolt latch 7 is made to swing further clockwise in FIG. 2 until all wedge surfaces lie firmly one against the other, then, as a result of the force components of the spring 16 operating in the over dead-center position in the direction of the cam-shaped projection 30, the manual operating lever 11 will be swung correspondingly a little further and the cam-shaped projection 30 and the end 31 of the bolt latch 7 remain abutting against each other in every position. In this way, an automatic resetting is achieved, so that idle movement or play can never arise between the parts to be coupled. This represents a major advantage compared with other known devices of this type, along with the further advantages in that the device is very simple to operate and that, because of the small dimensions, it can be incorporated very close to the end of the frame stave of the heddle frame, in mirror image fashion at both ends.

What is claimed is:

1. A device for coupling a heddle frame with an oscillatory drive element comprising, a pair of coupling elements which are engageable one into the other and which, in use, are respectively disposed on a frame stave of said heddle frame and on said oscillatory drive element, a bolt latch comprising a pivotally mounted part of one of the coupling elements and being capable of pressing against the other coupling element when the coupling elements are engaged, the bolt latch having wedge surfaces extending transversely to the direction of drive and arranged to co-operate with matching surfaces on the other coupling element when the latch is pressed against it to produce a positive locking of the coupling elements in the engaged position, a toggle lever hinged to the bolt latch for operating the bolt latch and being pivotally mounted on said one coupling element, said toggle lever being pivotable against the action of a compression spring into an over dead center position in which the bolt latch is in the locking position, the toggle lever comprising an operating lever and a lever element interconnected by a joint, the lever element being hinged at one end to the bolt latch, and the compression spring abutting on said joint and on the end of the lever element which is connected to the bolt latch.

2. A device according to claim 1, wherein the compression spring comprises a helical compression spring, the lever element comprising a bolt-shaped part having a first abutment rigidly mounted at one end thereof at said joint, and a second abutment mounted at the opposite end thereof for movement relative to the bolt-shaped part in a longitudinal direction to a limited extend as permitted by stops provided in said second abutment, the spring being arranged on the bolt-shaped part between said first and second abutment, the spring being under compression in a release position of the bolt latch and of the toggle lever, and being further compressed in the locking position to the extent of the shortening of the distance between the abutments permitted by the stops.

3. A device according to claim 2, wherein the abutments for the helical compression spring comprise hinge parts for the hinged connection of the lever element at one end to the bolt latch and at the other end to the operating lever.

4. A device according to claim 2, wherein the second abutment comprises a sleeve-shaped element having a first transverse hole, a second transverse hole in said bolt-shaped part, a pin extending transversely through said holes, and the pin having a diameter smaller than that of the first transverse hole such that opposite edges of the first hole define said stops.

5. A device according to claim 1, wherein the bolt latch is L-shaped, and the operating lever has a cam-shaped projection which abuts against an angled end of the L-shaped bolt latch in the over dead center position of the toggle lever in such a way that a lip of the bolt latch and the cam-shaped projection mutually support each other, even when the position of the bolt latch has altered through wear, thus ensuring play-free mutual engagement of the coupling elements.

6. A device according to claim 1, wherein the wedge surfaces on the bolt latch and the matching surfaces on the other coupling element are formed by mutually engageable toothings.

7. A device according to claim 6, wherein said one coupling element forms a socket for receiving said other coupling element, and said other element has on its side opposite the toothing at least one longitudinally extending strip which is wedge-shaped in cross-section and which, on effecting the coupling connection, is received by a longitudinal groove of corresponding wedge-shaped cross-section in the inside wall of the socket element, the strip being pressed into the longitudinal groove so as to achieve a friction locking engagement when the toggle lever is in the over dead center position and the bolt latch is in the locking position.

* * * * *